United States Patent [19]

Kato

[11] Patent Number: 5,018,998

[45] Date of Patent: May 28, 1991

[54] COWLING ARRANGEMENT FOR OUTBOARD MOTOR

[75] Inventor: Naoki Kato, Hamamatsu, Japan

[73] Assignee: Sanshin Kogyo Kabushiki Kaisha, Hamamatsu, Japan

[21] Appl. No.: 492,714

[22] Filed: Mar. 13, 1990

[30] Foreign Application Priority Data

Mar. 13, 1989 [JP] Japan ..... 1-60258

[51] Int. Cl.[5] ..... B63H 21/24

[52] U.S. Cl. ..... 440/77; 123/195 P; 440/900

[58] Field of Search ..... 440/76–78, 440/900; 123/195 P, 195 C; 244/129.4; 150/52 R; 180/69.2, 69.24

[56] References Cited

U.S. PATENT DOCUMENTS 2,501,470 3/1950 Krueger et al. ..... 440/77

3,955,526 5/1976 Kusche ..... 123/195 P X

*Primary Examiner*—Ed Swinehart

*Attorney, Agent, or Firm*—Ernest A. Beutler

[57] ABSTRACT

A cowling arrangement and fitting structure for an outboard motor is provided for positioning a top cover of the cowling onto a cowling tray member. Column shaped bosses are preferably integrally formed on the inner wall of the top cover and are adapted for engagement with corresponding positioning bosses preferably integrally formed on the inner wall of the tray member. This fitting structure produces a flush and accurate fit between the adjoining surfaces of the top cover and tray.

9 Claims, 2 Drawing Sheets

COWLING ARRANGEMENT FOR OUTBOARD MOTOR

BACKGROUND OF THE INVENTION

This invention relates to a cowling arrangement for an outboard motor, and more particularly to an improved cowling arrangement wherein a fitting structure is provided for positioning a top cover of the cowling on a cowling tray member during attachment of the top cover to the tray.

It is well known with outboard motors that the powering internal combustion engine is normally enclosed within a protective cowling so as to provide protection for the internal combustion engine, to suppress engine noise, to protect users from contact with the engine, and to provide a better appearance for the outboard motor. The protective cowling defines a cavity in which the engine is contained.

One type of cowling includes a top cover and a tray member that is affixed to the lower end of the internal combustion engine. The top cover has a generally inverted cup shape and is attached to the tray member. When so attached, this top cover defines a cavity in which the engine is contained.

However, as the size of the outboard motor increases, the size of the cowling likewise increases, making it more difficult to correctly position the top cover on the tray member. As a result, cowlings for larger outboard motors typically have been provided with a structure for positioning the top cover relative to the tray member. This structure includes a positioning member integrally formed with the cowling tray and a second member adapted for engagement with the positioning member. This second member is attached to the top cover by means of rivets or the like that are inserted through holes drilled in the surface of the top cover which adjoins the tray when the two cowling parts are attached. While this type of cowling is generally satisfactory in performing the above functions, it has been unable to provide a flush fit between the adjoining surfaces of the top cover and the tray since the heads of the rivets or the like are exposed on the mating surface of the top cover. In addition, because the second member is not integral with the top cover, the top cover may be or become improperly positioned on the tray, particularly if the second member becomes loose.

It is, therefore, a principal object of this invention to provide an improved cowling arrangement including a fitting structure for an outboard motor which will produce a flush fit between the adjoining surfaces of the top cover and cowling tray.

It is a further object of this invention to provide an improved cowling arrangement including a fitting structure which enables the top cover to be positioned more accurately on the cowling tray and which eliminates the need for protrusions on the adjoining surfaces of the top cover and tray.

SUMMARY OF THE INVENTION

A cowling is provided for enclosing the engine of an outboard motor. The cowling comprises a top cover having an inner wall, a tray member having an inner wall, at least one positioning boss preferably integrally formed on the inner wall of the tray member and at least one column shaped boss preferably integrally formed on the inner wall of the top cover. In accordance with the invention, the column shaped boss has a lower portion adapted for engagement with the positioning boss.

Another embodiment of the invention comprises a cowling which also includes a top cover having an inner wall and a tray member having an inner wall. In this embodiment of the invention, a plurality of positioning bosses on the inner wall of the tray member are provided as well as a plurality of column shaped bosses on the inner wall of the top cover. In accordance with this embodiment of the invention, each of the column shaped bosses has a lower portion adapted for engagement with a corresponding positioning boss. The bosses are preferably integrally formed on the inner walls of the respective cowling parts.

DETAILED DESCRIPTION OF THE PREFERRED EMBODIMENTS

Figure 1:
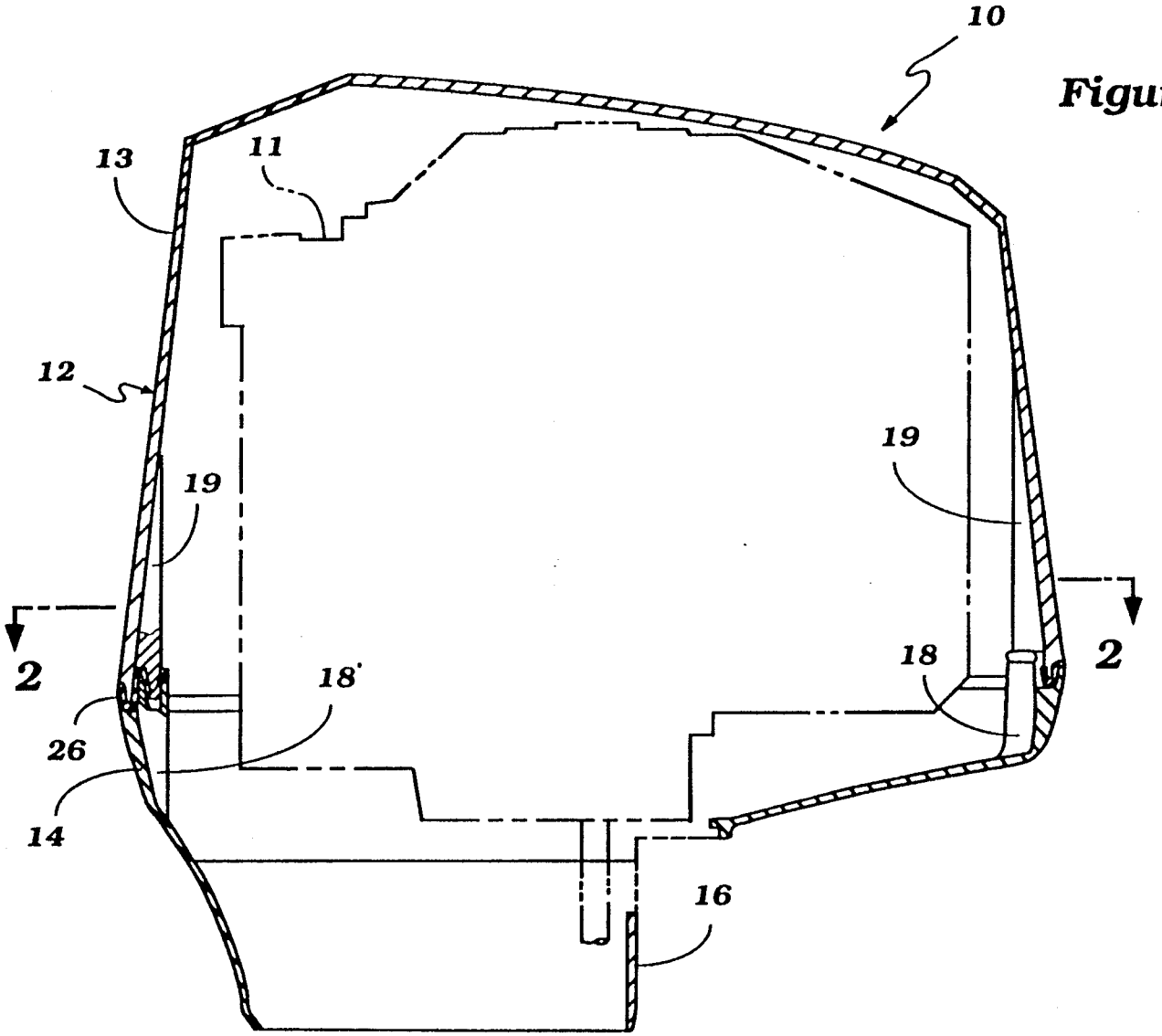
FIG. 1 is a partial side elevational view of an outboard motor showing the fitting structure and cowling with portions broken away and other portions shown in cross section.

Referring first to FIG. 1, the power head of an outboard motor is identified generally by the reference numeral 10. The power head 10 contains an internal combustion engine 11 which is surrounded by a protective cowling 12, which includes a top cover 13 and a tray member 14 constructed in accordance with an embodiment of the invention.

The internal combustion engine 11 drives an output shaft which, in turn, drives a drive shaft that is journaled for rotation within a drive shaft housing that depends from the powerhead 10. This drive shaft drives a propeller of a lower unit by means of a conventional forward, reverse, neutral transmission.

A steering shaft is typically affixed to the drive shaft housing in a known manner and is supported for steering movement about a generally vertically extending axis within a swivel bracket assembly. This swivel bracket assembly is, in turn, pivotally connected to a clamping bracket by means of a tilt shaft for tilt and trim movement of the outboard motor. The clamping bracket includes means for affixing the outboard motor to the transom of an associated watercraft.

The construction of the outboard motor, except for the cowling arrangement and fitting structure to be described, may be considered conventional and, for that reason, those components which are not illustrated and which have not been described in any more detail may take the form of any of the known components used in this field. Also, although the invention has been described in connection with an internal combustion engine 11, it is to be understood that the invention may also be utilized in conjunction with other types of engines, including electric engines.

Referring to the protective cowling 12 of the powerhead 10, the bottom cowling or tray member 14 is preferably affixed to the lower end of the engine 11. The top cover 13 is typically formed from a lightweight plastic material and has a generally inverted cup shape. A latching mechanism is identified by the reference numeral 15 for detachably affixing the top cover 13 and tray 14 to each other and which may be of the type generally described in the co-pending application entitled "Latching Mechanism for Outboard Motor Cowling", Ser. No. 400,159, filed Aug. 28, 1989 in the name of Eifu Watanabe and assigned to the assignee of this application. This latching mechanism 15 typically includes a pair of latch keepers that are formed at the lower end of the top cover 13 for cooperation with a pair of releasable connecting mechanisms carried by the tray 14. One latch keeper and corresponding connecting mechanism is positioned in the front portion of the cowling 12 and another in the rear portion. Since the latching mechanism per se forms no part of the invention, further description is not necessary and reference may be made to the aforementioned co-pending application for details of a specific latching mechanism that may be utilized in conjunction with the invention. When affixed to the tray 14, this top cover 13 defines a cavity in which the engine 11 and its associated parts are contained. A cowling apron 16 extends downward from the tray member 14 to the drive shaft housing, as shown in FIG. 1.

Figure 2:
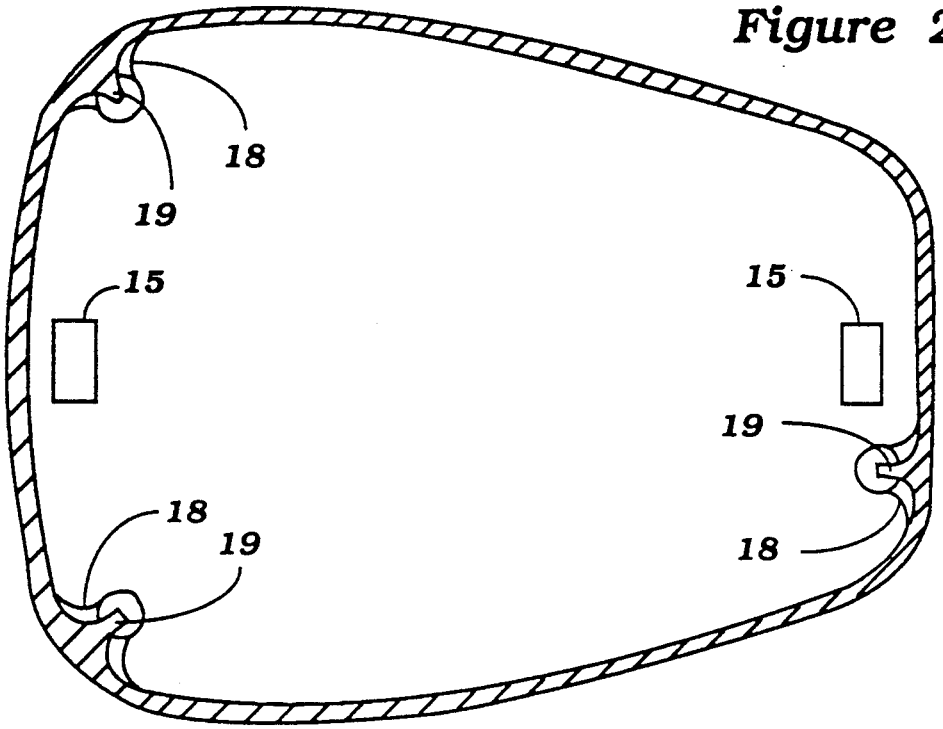
FIG. 2 is a cross sectional view taken along line II—II of FIG. 1.
Figure 3:
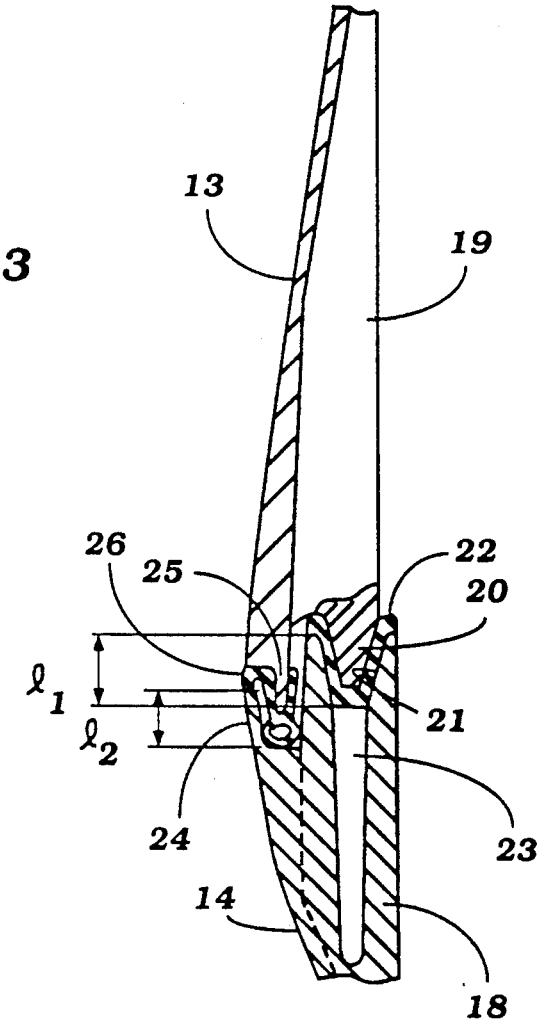
FIG. 3 is an enlarged cross sectional view of the fitting structure of FIG. 1.

Referring now to FIGS. 2 and 3, three (3) positioning bosses identified by the reference numeral 18 are integrally formed on the inner wall of the tray member 14, two in the front portion of the tray 14 and one in the rear portion. This is the preferred arrangement for the positioning bosses 18, although other arrangements may be used. Three (3) column or pillar shaped bosses 19 are integrally formed on the inner wall of the top cover 13 at locations corresponding to the locations of the three (3) positioning bosses 18 on the tray member 14. Each of these column shaped bosses 19 has a lower portion 20 which is adapted for engagement with a corresponding recess 21 formed within each of the positioning bosses 18. The lower portions 20 of the column shaped bosses 19 are tapered from wide to narrow in a downward direction toward the tray member 14, when the top cover 13 and tray member 14 are attached. The recesses 21 formed in the positioning bosses 18 are also tapered from wide to narrow in that same downward direction for receiving the lower portions 20 of the column shaped bosses 19, and to insure a secure fit between the top cover 13 and tray member 14. A dampening member 22 made of rubber or other similar material is positioned within each of the recesses 21 for absorbing shocks which may occur during attachment of the top cover 13 to the tray member 14 or vibrations which can occur during operation of the outboard motor. A recess 23 is also formed within each of the positioning bosses 18 below recess 21.

As shown in FIG. 3, the peripheral edge of the tray member 14 is formed with an upstanding portion 24 that extends around the outer periphery of the tray member 14 adjacent a generally horizontally extending sealing surface. In a similar manner, the outer surface of the top cover 13 is provided with a downwardly extending flange 25 that is positioned inwardly from a sealing surface on the top cover 13. A seal member 26 is provided for sealing between these two surfaces. The seal member 26 is designed so as to be affixed to one or the other of the top cover 13 or tray 14 and sealingly engaged to the other of these members. The seal member 26 may be of the type generally described in the co-pending application entitled "Seal Member For Outboard Cowling", Ser. No. 427,755 filed Oct. 26, 1989 in the names of Naoki Kato and Michihiro Tagushi and assigned to the assignee of this application. This seal member 26 per se is not part of the invention, and for that reason further description is not believed to be necessary. Reference may be made to the aforementioned co-pending application for details of a specific seal member that may be utilized in connection with this invention.

When the top cover 13 and tray member 14 are attached, for each of the positioning bosses 18 and corresponding column shaped bosses 19, the fitting length ($l_1$) between the top of the positioning boss 18 (excluding the dampening member 22) and the bottom of the recess 21 (excluding the dampening member 22) is greater than the fitting length ($l_2$) represented by the length of the upstanding portion 24 of the tray member 14, as shown in FIG. 3.

With the type of fitting structure described above, the top cover 13 can be accurately positioned on the tray member 14 during attachment of these two cowling parts. Protrusions resulting from rivet heads and the like on adjoining surfaces of the top cover 13 and tray member 14 are also eliminated with this type of fitting structure. Moreover, because the bosses 18 and 19 are integrally formed on the tray member 14 and top cover 13 respectively, they have sufficient strength to prevent these cowling parts 13 and 14 from being disengaged from one another in the event the outboard motor collides with floating debris such as wood during operation.

It should be readily apparent from the foregoing description that this invention is highly effective in providing a cowling arrangement and fitting structure which will result in an accurate and flush fit between the adjoining surfaces of the top cover 13 and tray member 14. Although this is the case, various changes and modifications may be made without departing from the spirit and scope of the invention as defined by the appended claims.

I claim:

1. A cowling for enclosing the engine of an outboard motor comprising a top cover having an inner wall and a sealing surface, a tray member having an inner wall and a sealing surface adapted to engage said top cover sealing surface when said top cover and said tray member are attached, at least one positioning boss integrally formed on the inner wall of said tray member and at least one column shaped boss integrally formed on the inner wall of said top cover and having a lower portion for engagement with said positioning boss, said positioning boss being located adjacent said tray member sealing surface and said column shaped boss being located adjacent said top cover sealing surface so as to accurately align said sealing surfaces against each other when said top cover and said tray member are attached.

2. A cowling as recited in claim 1, wherein said positioning boss has a recess formed therein for receiving the lower portion of said columned shaped boss.

3. A cowling as recited in claim 2, wherein the recess of said positioning boss includes a dampening member therein.

4. A cowling as recited in claim 3, wherein the lower portion of said column shaped boss tapers from wide to narrow in a downward direction when said top cover and said tray member are attached.

5. A cowling as recited in claim 4, wherein said tray member has an upstanding portion and wherein the length between the top of the positioning boss and the bottom of the recess formed in said positioning boss is greater than the length of the upstanding portion of said tray member.

6. A cowling for enclosing the engine of an outboard motor, comprising a top cover having an inner wall and a sealing surface, a tray member having an inner wall and a sealing surface adapted to engage said top cover sealing surface when said top cover and said tray member are attached, a plurality of positioning bosses integrally formed on the inner wall of said tray member and a plurality of column shaped bosses integrally formed on the inner wall of said top cover, each of said column shaped bosses having a lower portion for engagement with a corresponding one of said positioning bosses, said positioning bosses being located adjacent said tray member sealing surface and said column shaped bosses being located adjacent said top cover sealing surface so as to accurately align said sealing surfaces against each other when said top cover and said tray member are attached.

7. A cowling as recited in claim 6, wherein each of said positioning bosses has a recess formed therein for receiving the lower portion of one of said column shaped bosses.

8. A cowling as recited in claim 7, wherein each of the recesses of said positioning bosses includes a dampening member therein.

9. A cowling as recited in claim 8, wherein the lower portion of each of said column shaped bosses tapers from wide to narrow in a downward direction when said top cover and said tray member are attached.

* * * * *